US005641103A

United States Patent [19]

Potik et al.

[11] Patent Number: 5,641,103

[45] Date of Patent: Jun. 24, 1997

[54] BALL SLEEVE

[76] Inventors: Gregory J. Potik, 723 Ocean Front Walk, Venice, Calif. 90291; Ross T. Yamamoto, 1007 Manhattan Beach Blvd., Manhattan Beach, Calif. 90266

[21] Appl. No.: 506,238

[22] Filed: Jul. 24, 1995

[51] Int. Cl.[6] ..... A45F 5/00

[52] U.S. Cl. ..... 224/251; 224/918; 224/919

[58] Field of Search ..... 224/252, 918, 224/919, 226, 268, 251; 206/315.5, 315.9

[56] References Cited

U.S. PATENT DOCUMENTS

| | | | |
|---|---|---|---|
| 3,968,522 | 7/1976 | Riess | 224/918 |
| 4,678,108 | 7/1987 | Inman | 229/918 |
| 4,730,728 | 3/1988 | Larkin | 224/918 |
| 4,784,305 | 11/1988 | Schoenberg | 224/918 |
| 4,875,579 | 10/1989 | Tak | 224/919 |
| 5,186,374 | 2/1993 | Buxton | 229/919 |
| 5,423,530 | 6/1995 | Gonzalez | 229/918 |

*Primary Examiner*—David J. Walczak

[57] ABSTRACT

The present invention relates to a golf ball sleeve adapted for the simple, convenient and silent insertion, storage, and retrieval of balls during a golf game. The holder comprises a sleeve of material that is open at two ends which sleeve retains one or more golf balls therein. The material comprising the sleeve is sufficiently elastic to allow easy insertion and removal of the golf balls from either end of the sleeve while also retaining one or more golf balls within the sleeve.

4 Claims, 3 Drawing Sheets

FIGURE 8
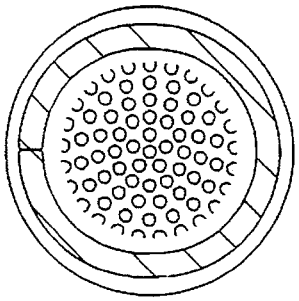
FIGURE 7
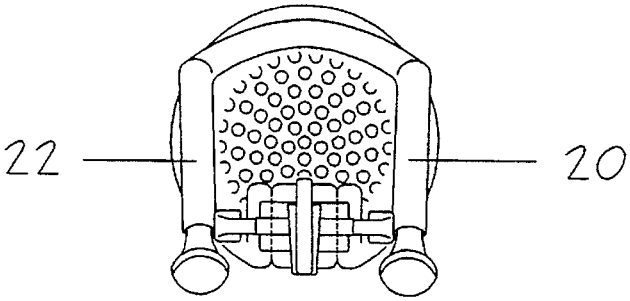
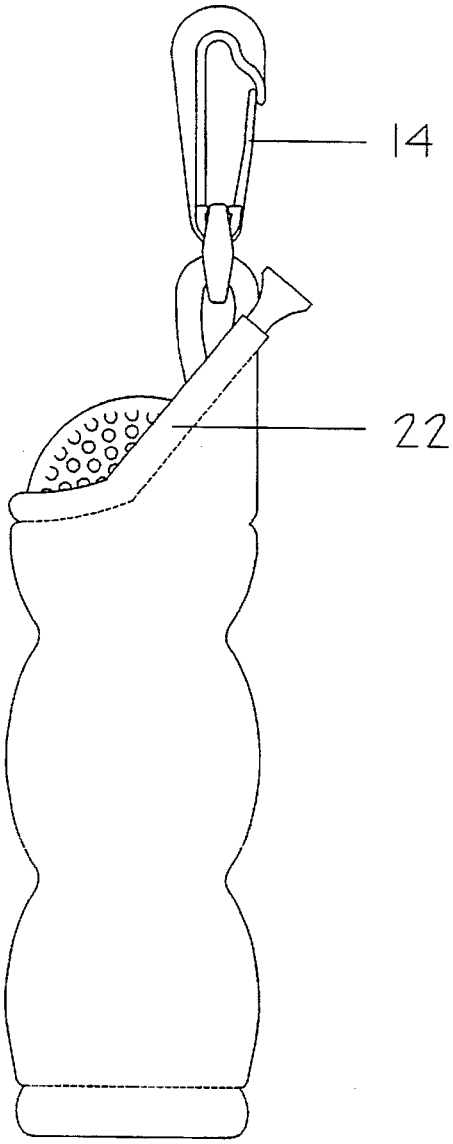
FIGURE 6

BALL SLEEVE

BACKGROUND OF THE INVENTION

A. Field of the Invention

The present invention relates to a ball sleeve adapted for the simple, convenient and silent insertion, storage, and retrieval of golf balls during a game.

B. Description of the Prior Art

There are in the prior art various golf ball holders in which a number of golf balls are stacked in a cylindrical housing, with the golf balls being able to be dispensed one at a time from the lower end of the housing. During actual play of a golf game, this provides the player with a convenient means of obtaining a new golf ball when the previous golf ball is either lost or damaged.

Typical of these devices are holders comprised of a rigid golf ball holder and articulating means to retain the golf balls within the holder. Some retain golf balls in a cylindrical container by means of resilient or displaceable fingers (Houser, U.S. Pat. No. 2,768,775; Sanders, U.S. Pat. No. 4,082,209; Naggar, U.S. Pat. No. 3,497,118) or an annular rubber retaining member that is deflected to allow ball removal (Morss, U.S. Pat. No. 1,778,225), Another holder comprises a cylindrical container with wire ball retaining members (Joliot, U.S. Pat. No, 3,777,933; Motard, U.S. Pat. No. 3,281,013). Still another requires removal of a cap at the bottom of the holder to release the golf balls from their holder (Anderson, U.S. Pat. No. 1,754,495). One integrally molded holder with two open ends retains the golf balls within the holder either by means of a holding means comprising integrally molded cylindrical tubes or by means of a spring tongue. (Thomas, U.S. Pat. No. 4,106,678).

Another slightly different type of holder is formed of substantially rigid but somewhat pliable material comprising a generally cylindrical tubular member with two open ends and an elongated aperture running the length of the member. (Hoyt, U.S. Pat. No. 4,840,332). Golf balls are inserted into the holder by displacing the pliable walls of the tubular member sufficiently to allow insertion therein. The '332 holder retains golf balls by means of stop members at the upper and lower ends of the tubular member.

None of the prior art holders solve the problem that golfers face of maintaining the respectful silence demanded of players while another concentrates on playing the game. Further, all of the prior art holders are relatively expensive to produce, requiring creation of molded tubular housings for retaining the golf balls and creation of articulating ball retention members. Still further, holders made of rigid material may scratch other golf items, or be scratched by them, causing superficial and unsightly marks.

The ball sleeve of the present invention provides a ball holder that is easy and inexpensive to manufacture and has no articulating parts, dispenses balls easily and silently, and will not mark other equipment. It can be folded completely flat when empty, and rolled or stuffed into a small area when space is at a premium.

SUMMARY OF THE INVENTION

The invention relates to ball holders, and in particular golf ball holders that are used during a game of golf. It is adapted to be attached to the top of a golfer's bag, golf cart or belt loop. The holder comprises a sleeve of material that is open at two ends, which sleeve retains one or more golf balls therein. The material comprising the sleeve is sufficiently elastic to allow easy insertion and removal of the golf balls from either end of the sleeve while also retaining a one or more of golf balls within the sleeve. The sleeve keeps golf balls organized and readily accessible.

Additionally, the holder may have one or more channels for inserting and retaining golf tees.

One such suitable elastic material for sleeve construction is neoprene, a material from which wet suits for surfing and water sports are constructed. However, any material that is elastic or rubbery enough to retain a one or more of golf balls in a sleeve with two open ends can be used. Because the sleeve is constructed from elastic or rubbery material, it will not scratch or damage other surfaces. Construction of golf ball sleeves from such material is cost effective to mass produce. Additionally, it makes no noise when used, and noises are distracting to golfers during teeing off and other aspects of the game.

A golf ball is inserted into the holder by urging the ball into an opening at either end of the cylindrical sleeve. The elastic property of the material from which the holder is constructed, combined with the sleeve having a diameter less than the diameter of a golf ball, causes the ball to be retained within the sleeve. To remove the ball, pressure is exerted on a ball through the sleeve to urge the ball out one of the openings of the sleeve. Insertion and removal can be done silently, so as to avoid distracting another golfer during a game, because there are no articulating parts to make noise as they move to release the ball. Additionally, because the holder is made from a soft, pliable material, it does not make noise if it bumps against a hard surface.

Golf is a game requiring mental concentration combined with muscular relaxation. A golfer's knowledge that golf balls are readily available, and that golf balls can be inserted into, retained within easy reach, and retrieved without disturbing other players improves concentration and increases relaxation by decreasing the number of distractions and concerns for the golfer and for other players nearby.

BRIEF DESCRIPTION OF THE DRAWINGS

The preferred embodiment of this invention illustrating all of its features will now be discussed in detail with reference to the attached drawings, wherein like numerals indicate like parts, and in which:

FIG. 6 is a right side view of the golf ball holder according to the invention holding three golf balls and two golf tees.

FIG. 7 is a top view of the golf ball holder according to the invention holding three golf balls and two golf tees.

FIG. 8 is a cross-sectional view at line B—B of FIG. 5.

DESCRIPTION OF THE PREFERRED EMBODIMENT

Figure 4:
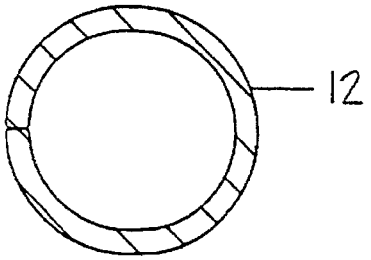
FIG. 4 is a cross-sectional view at line A—A of FIG. 2.
Figure 3:
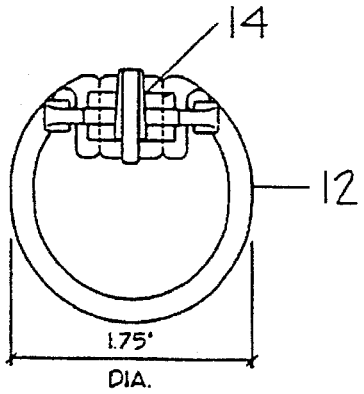
FIG. 3 is a top view of the empty golf ball holder according to the invention.
Figure 2:
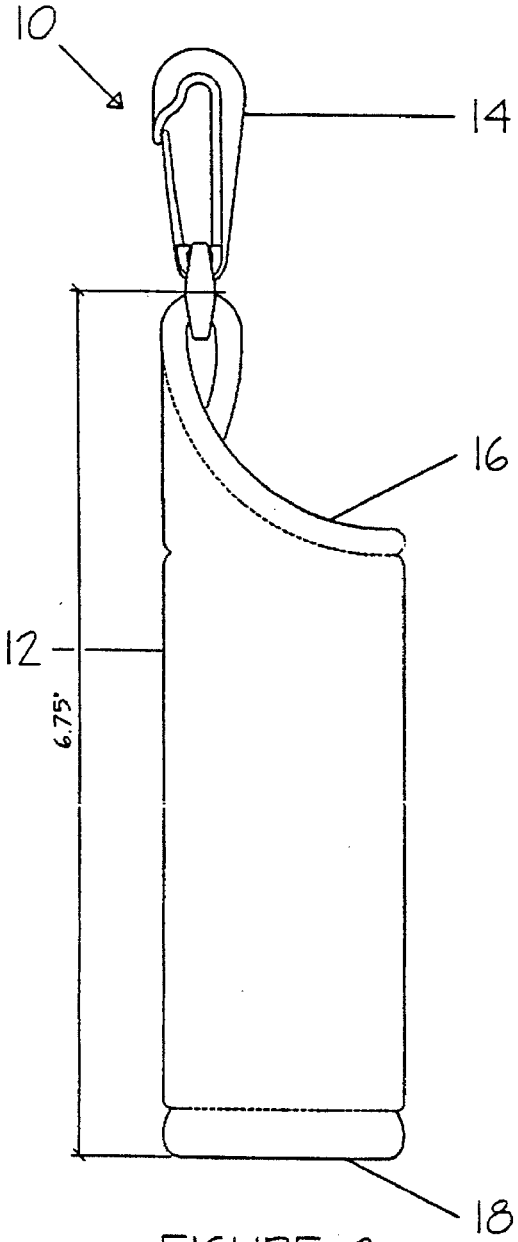
FIG. 2 is a left side view of the empty golf ball holder according to the invention.
Figure 1:
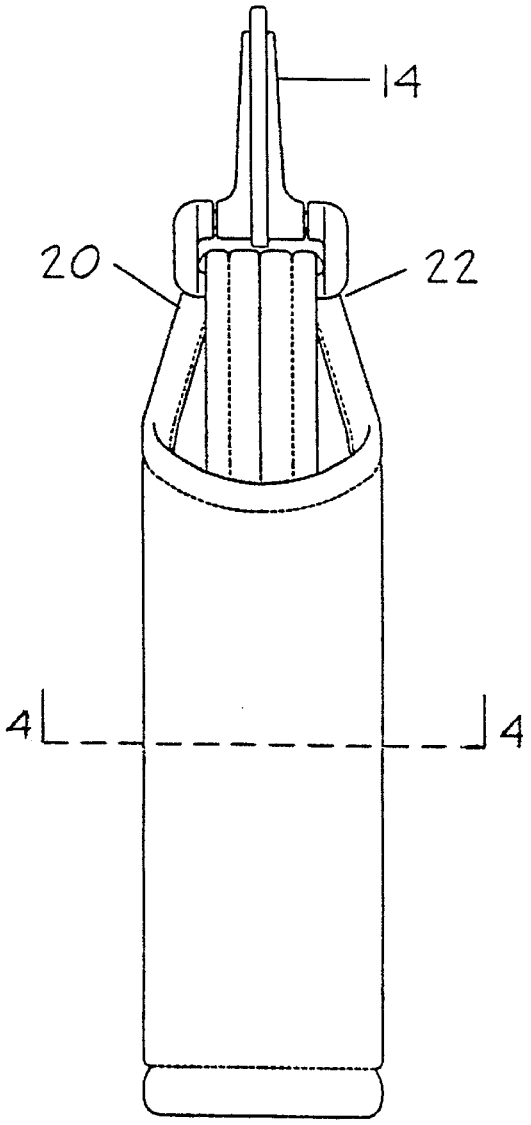
FIG. 1 is a front view of the empty golf ball holder according to the invention.
Figure 5:
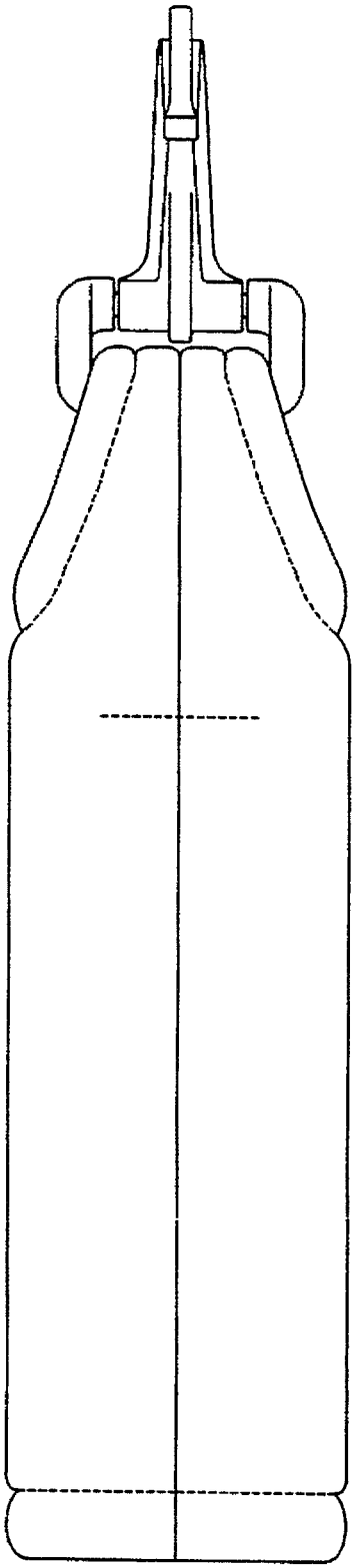
FIG. 5 is a front view of the golf ball holder according to the invention holding three golf balls and two golf tees.

As illustrated in the drawings, the golf ball holder of the invention 10 comprises a cylindrical sleeve 12 and a sleeve attachment means in the form of a clip 14. The cylindrical sleeve 12 has a substantially circular cross section, but because the cylindrical sleeve 12 is constructed of an elastic, pliable material, the cross section is not necessarily circular, except when the sleeve contains one or more golf ball.

The sleeve 12 is constructed of material sufficiently elastic to retain within the sleeve a one or more of golf balls in substantially vertical alignment. In a preferred embodiment, that material is neoprene. The sleeve 12 when empty has an internal diameter less than the diameter of a golf ball.

Golf balls are typically sold in packages containing three balls. In a preferred embodiment, the sleeve 12 is configured to retain three golf balls. The exact length and diameter of the sleeve 12 are dependant on the type of elastic material used for the sleeve. When the material is neoprene, the internal diameter is from about 1 inch to about 3.5 inches, and the length is from about 0.5 inch to about 10 inches.

The sleeve 12 has a first opening 16 and a second opening 18. These first and second openings 16, 18 are positioned at opposite ends of the cylindrical sleeve 12. The diameter of the openings 16, 18 varies with the material used to construct the sleeve 12. When neoprene is the material used, the diameter of each opening is from about 1 inch to about 3 inches.

In addition to neoprene, other rubbery or elastic materials, or combination of rigid, rubbery, elastic and inelastic materials, may be used in the construction of this invention. The requirement of the materials used, alone or in combination is that they hold one or more golf balls in substantially vertical alignment within the open-ended sleeve.

The cylindrical sleeve 12 of the holder 10 can be attached to a golfer's clothing, a golf bag or a golf cart by a sleeve attachment means 14 positioned proximate one opening 16 of the cylindrical sleeve 12. In a preferred embodiment, the attachment means 14 comprises a fastener.

The invention also provides a means for carrying up to two golf ball tees. A one or more of golf ball tee holders comprising channels 20, 22 are proximate the sleeve attachment means 14. In a preferred embodiment, the opening of each golf tee holder channel 20, 22 is proximate the sleeve attachment means 14. The diameter of each golf tee holder channel 20, 22 is less than the diameter of a golf tee, and the tee must be urged into the channel 20, 22 to be retained. The elastic nature of the neoprene or other elastic material defining the golf tee holder channel allows retention of the golf tee even if the golf ball holder 10 is inverted.

The invention further provides for means to attach, carry, and detach golf ball markers (not shown). Markers are constructed with an integral male standard size snap that provides attachment means to a female standard size snap. One or more female standard size snaps may be provided on the golf ball sleeve for attachment thereto of golf ball markers.

While the embodiment described above is directed to holding golf balls, it is contemplated that various balls, including but not limited to tennis balls, pool balls or baseballs can be held in such a holder. In such a case, the dimensions of the sleeve are appropriately modified to accommodate the different sized balls.

What is claimed is:

1. A ball holder comprising:

a. a cylindrical sleeve, (1) first and second openings positioned at opposite ends of said cylindrical sleeve wherein said first opening includes a peripheral edge, (2) said sleeve being constructed of a material sufficiently elastic and adapted to retain at least one ball therein.

(3) said sleeve having an internal diameter less than a diameter of a retained ball to be retained within said sleeve when said sleeve is empty and wherein both of said openings enable easy insertion, retention and removal of balls from said sleeve;

b. a sleeve attachment means positioned proximate said first opening of said cylindrical sleeve and adapted to mount said ball holder onto a separate article; and at least one pocket positioned on said peripheral edge and adapted to receive a golf ball tee therein.

2. The ball sleeve according to claim 1 wherein said attachment means is a clip.

3. The ball sleeve according to claim 1 wherein said material is neoprene.

4. The golf ball sleeve according to claim 1 wherein said sleeve is adapted to retain one or more golf balls.

* * * * *